United States Patent [19]

Allison

[11] 3,937,948

[45] Feb. 10, 1976

[54] LIGHT FIXTURE

[75] Inventor: Donn Allison, Saugus, Calif.

[73] Assignee: Donn Allison, Saugus, Calif.

[22] Filed: Aug. 14, 1974

[21] Appl. No.: 497,283

[52] U.S. Cl. ..... 240/78 R; 240/103 R; 350/291

[51] Int. Cl.[2] ..... F21S 1/04

[58] Field of Search ..... 240/4.1, 4.2, 41.35, 78 R, 240/78 G, 103 R, 104, 108, 109, 10 R; 350/291, 299; 40/219, 28 B, 131

[56] References Cited

UNITED STATES PATENTS

| | | | |
|---|---|---|---|
| 909,450 | 1/1909 | Perkins | 350/291 X |
| 951,126 | 3/1910 | Jenkins | 350/4 |
| 1,786,033 | 12/1930 | Smith | 40/219 X |
| 2,075,613 | 3/1937 | Horinstein | 40/28 B |
| 2,132,472 | 10/1938 | Holm | 40/28 B |
| 2,286,247 | 6/1942 | Yearta | 40/28 B X |
| 3,292,287 | 12/1966 | Marn | 40/219 X |
| 3,610,918 | 10/1971 | Barlow | 40/219 X |
| 3,711,188 | 1/1973 | Zehnpfennig | 350/291 |
| 3,823,500 | 7/1974 | Spitz | 40/219 |

FOREIGN PATENTS OR APPLICATIONS

| | | | |
|---|---|---|---|
| 353,216 | 7/1931 | United Kingdom | 240/108 |
| 474,364 | 11/1937 | United Kingdom | 350/299 |

*Primary Examiner*—Joseph F. Peters, Jr.
*Assistant Examiner*—Alan Mathews
*Attorney, Agent, or Firm*—LeBlanc & Shur

[57] ABSTRACT

Disclosed is a light fixture having mirrored surfaces angularly related one to the other and about a light source. The mirrors are either all two-way mirrors or a combination of two-way and one-way mirrors. The arrangement of the mirrors about the light source presents a three-dimensional multiple light source effect, particularly a series of discrete light sources which diminish in intensity and size with depth. Variations of the light fixtures hereof include multisided fixtures, for example fixtures triangular, hexagonal, octagonal, etc. in shape, all particularly arranged to present the foregoing optical effect.

11 Claims, 12 Drawing Figures

LIGHT FIXTURE

The present invention relates to a light fixture and particularly relates to a multiple mirrored light fixture for presenting a three-dimensional multiple light source effect characterized by a series of discrete light sources which diminish in intensity and size with depth and repetitiously fade to infinity to produce a kaleidoscopic lighting effect.

Many and various types of light fixtures have been proposed and constructed in the past. Typical of such fixtures is a light producing element, for example an electric light bulb, and surrounded by a transparent or transluscent material such as glass or plastic which may also be tinted. The light rays from the light source are usually transmitted directly through the enclosure material without noticeable reflection or unusual optical effect. Mirrors are used, albeit somewhat infrequently, with certain types of lighting fixtures and these usually comprise standard one-way mirrors serving as a background whereby light rays from the light source are reflected forwardly through a transparent enclosure to produce a greater intensity of the light and the illusion of multiple light sources. More recently, one-way and two-way mirrors have been used in combination in a light fixture to produce a three-dimensional optical lighting effect. For example, one such light fixture mounts a plurality of lights between a standard one-way mirror and a two-way mirror, such mirrors being disposed in spaced parallel planes relative to one another. The light rays are reflected from the one-way mirror and a part of these, along with part of the light rays directed forwardly from the light source, are transmitted through the two-way mirror. The remaining parts of such light rays are reflected back for further reflection by the one-way mirror and further partial transmission through and reflection from the two-way mirror. This partial transmission and reflection continues and produces a three dimensional optical effect with a plurality of apparent discrete lights fading in intensity with depth. Such fixtures, however, still make use of and require a significant number of light producing elements to produce the desired effect. Also, such fixtures are not particularly adaptable for three-dimensional lighting, for example, a light fixture comprising a hanging lamp.

The present invention provides a light fixture which minimizes or eliminates the foregoing and other disadvantages associated with prior light fixtures and provides a novel and improved multiple mirrored light fixture having various advantages in construction and optical effect in comparison with such prior light fixtures. Particularly, the present fixture provides a multiple mirrored light fixture comprised of a light producing source, i.e., an electric light bulb, which cooperates with a plurality of angularly related mirrors to produce a three-dimensional multiple light source effect from the single light source and which effect comprises particularly a series of apparent discrete light sources which diminish in intensity and size with depth and repetitiously fade to infinity. The optical effect is also kaleidoscopic when viewed from different angles. More particularly, the present invention makes use of either a plurality of two-way mirrors angularly related one to the other or a combination of two-way and one-way mirrors angularly related one to the other, each in optical relation to a light source, to produce the foregoing effect. For example, and in one form of the present invention, a light source is enclosed on three sides by planar extending mirrored surfaces. Two of the mirrored surfaces constitute standard one-way mirrors while the third mirror is a two-way mirror. Light rays produced by the light source are reflected from the two-way mirrors at various angles and together with the light rays projecting directly from the light source toward the two-way mirror in part pass through the two-way mirror and in part are reflected by the two-way mirror for further reflection by the one-way mirrors. The optical effect is that of multiple light producing elements disposed three-dimensionally which diminish in intensity and size with depth, which fade into infinity in the fixture, and which produce a changing light pattern, i.e., a kaleidoscopic effect when viewed from different angles. Another form of light fixture according to the present invention provides a housing which in platform and side elevation appears trapezoidal with the larger side constituting a two-way mirror and the other five sides constituting standard one-way mirrors. In this form, a pair of light sources adjacent opposite sides of the trapezoid are utilized. The optical effect is again three-dimensional presenting a visual impression of a plurality of discrete light sources which diminish in intensity and size with depth and fade into infinity in the light fixture. A variation of the foregoing provides the reversed miror arrangement. That is, the large mirror constitutes a standard one-way mirror while the other five sides of the fixture constitute two-way mirrors. Further embodiments of the present invention provide hexagonal, octagonal or other multi-sided light fixtures with various combinations of one-way and two-way mirrors arranged about the light source to similarly produce a three-dimensional multiple light source effect with the apparent discrete sources diminshing in intensity and size, fading into infinity into the fixture and affording a kaleidoscopic light pattern when viewed from various angles.

Accordingly, it is a primary object of the present invention to provide a novel and improved multiple mirrored light fixture.

It is another object of the present invention to provide a novel and improved multiple mirrored light fixture which provides a three-dimensional multiple light source effect wherein a plurality of apparent discrete light sources are produced from one or more actual light sources and which apparent light sources diminish in intensity and size, fade into the fixture and afford a kaleidoscopic light pattern when viewed from various angles.

It is still another object of the present invention to provide a novel and improved multiple mirrored light fixture wherein all two-way or combination one-way and two-way mirrors are arranged in angular relation one to the other to provide a three-dimensional multiple light source optical effect having the foregoing characteristics.

It is a further object of the present invention to provide a novel and improved multiple mirrored light fixture which is formed from standard readily available materials, which can be arranged in conventional as well as unique lighting designs, which can be inexpensively fabricated and which produces a multiple light source effect, such as produced by a chandelier from a single or minimum number of light sources.

These and further objects and advantages of the present invention will become more apparent upon reference to the following specification, appended claims and drawings wherein:

For convenience of illustration herein, the mirrored surfaces from which a single arrow extends normal to the surface thereof and which arrow is directed toward the light source as hereinafter identified indicates a standard one-way mirror. The double arrow which extends normal to both sides of the mirrored surfaces and in opposite directions indicates a two-way mirror. A two-way mirror constitutes a transparent element having a silvered or other light reflecting coating on one side whereby a portion of the light rays incident to the coated side are transmitted through the mirror and a portion of which light rays are reflected therefrom. The arrows extending from the surfaces in a direction away from the light source as hereinafter identified indicate a plane transparent or translucent surface.

Figure 1:
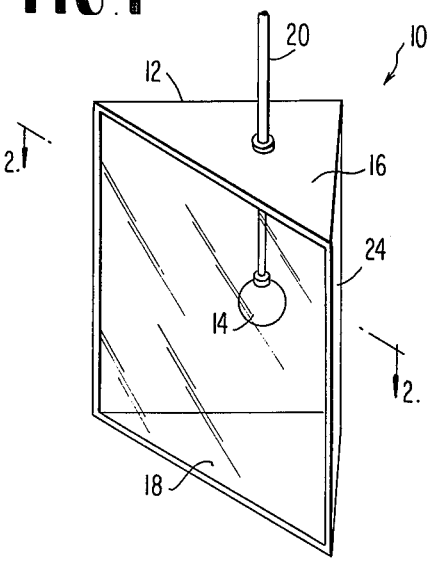
FIG. 1 is a perspective view of a multiple mirrored light fixture constructed in accordance with the present invention.
Figure 2:
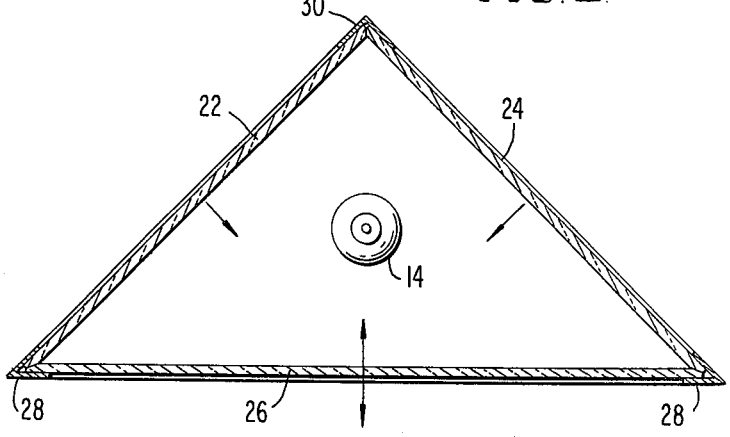
FIG. 2 is an enlarged cross-sectional view thereof taken generally about on line 2—2 in FIG. 1.

Referring now to the drawings and particularly to FIGS. 1 and 2, there is illustrated a multiple mirrored light fixture constructed in accordance with the present invention generally designated 10 and comprised of a housing 12 for a light source 14, for example an electric light bulb. Housing 12 is multi-sided and in this form is triangular in planform having a top wall 16 and a bottom wall 18. The light source 14, for example a light bulb, is suspended within the enclosure 12 by a wire 20 extending through the top wall 16 and which wire is coupled to a suitable electrical source. The wire 20 may also serve to support the light fixture or other means of support may be provided. The sides of housing 12 may constitute either planar two-way mirrors or a combination of two-way and one-way mirrors, each mirror lying in a plane angularly related. For example, in the illustration of FIGS. 1 and 2 the sides 22 and 24 are comprised of regular one-way mirrors while the third side 26 is comprised of a two-way mirror. The mirrors are connected one to the other at their adjoining edges by brackets 28 and 30 and which brackets are also suitably secured to the top 16 and bottom walls 18 respectively whereby an integral housing 12 is formed. With the illustrated arrangement and type of enclosure, it will be appreciated that the light rays produced by light source 14 and incident on the one-way mirrors 22 and 24 are reflected thereby toward one another or toward the two-way mirror 26. Such reflected light rays as well as the light rays directly incident on the two-way mirror 26 are in part transmitted through two-way mirror 26, and in part, reflected thereby. The light rays reflected by the two-way mirror 26 are in turn again reflected by one or both of the mirrors 22 and 24 toward the two-way mirror 26 for, in part, transmission therethrough and, in part, reflection therefrom. This sequence of reflection by the one-way mirrors, part transmission and part reflection by the two-way mirror continues with fading intensity.

The visual effect of the foregoing described arrangement of mirrored surfaces is that of a plurality of discrete light sources which diminish in intensity and size with their apparent depth location in the fixture and which apparent sources fade into infinity into the fixture. A kaleidoscopic effect is also produced when the fixture is viewed from various angles. It will be appreciated that the form of light fixture illustrated in FIGS. 1–2 is for lighting to one side of the fixture and for viewing from that one side. The sides of mirrors 22 and 24 may also be formed of two-way mirrors whereby the light fixture may disperse light about its entire periphery and also produce a like three-dimensional multiple light source optical effect when viewed from all sides thereof as described above. The top 16 and bottom walls 18 are opaque in the preferred embodiment hereof but may be formed of either one-way or two-way mirrored surfaces if desired to provide a like optical effect as above described from locations above or below the fixture.

Figure 3:
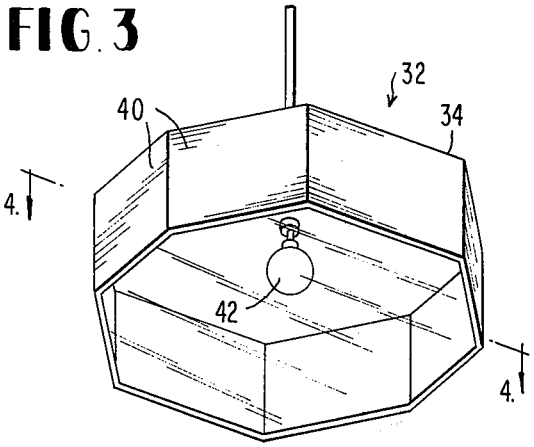
FIG. 3 is a perspective view of another form of multiple mirrored light fixture constructed in accordance with the present invention.
Figure 4:
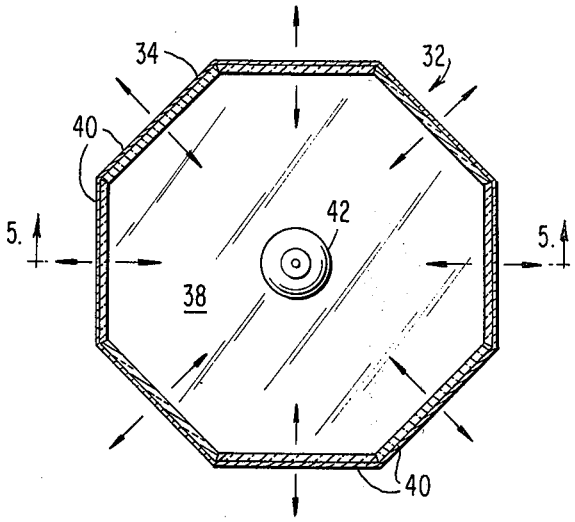
FIG. 4 is an enlarged cross-sectional view thereof taken generally about on line 4—4 in FIG. 3.
Figure 5:
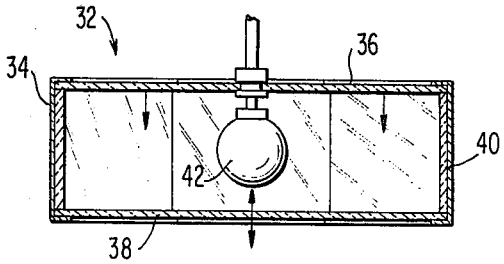
FIG. 5 is a cross-sectional view thereof taken generally about on line 5—5 in FIG. 4.

Referring now to the embodiment hereof illustrated in FIGS. 3–5, there is provided a light fixture generally designated 32 and comprised of a housing 34 having a top wall 36 and a bottom wall 38 between and about the periphery of which are disposed a plurality of discrete angularly related planar side surfaces 40. As illustrated in FIG. 4, side surfaces 40 form a generally octagon shaped housing 34 about a centrally disposed light source, i.e., a light bulb 42. In this form, the top wall 36 is comprised of a one-way mirror while the discrete planar sides 40 extending normal thereto are comprised of two-way mirrors, each of the mirrors 36 and 40 having their reflective surfaces directed toward light source 42. The bottom 38 comprises of a two-way mirror with the coated surface thereof facing light source 42 to reflect the light rays therefrom and the light rays reflected from the mirrors 36 and 40.

When bulb 42 is lit, part of the light rays are reflected from one-way mirror 36 and from the two-way mirrors 40 toward mirror 38 or are multiply reflected from mirrors 36 and 40 toward mirror 38 for, in part, transmission through the bottom two-way mirror 38 or for, in part, reflection therefrom back towards the mirrors 36 or 40. Part of the light rays from light 42 are also transmitted directly through the side two-way mirrors 40 and part will be reflected for ultimate transmission through either the two-way side mirrors 40 or two-way bottom mirror 38. The visual effect again is that of a plurality of three-dimensional multiple discrete light sources which diminish in intensity and size and fade in depth into the fixture with a kaleidoscopic pattern being produced when viewed from different angles. It will be appreciated that fewer or greater number of sides of the fixture may be provided and that a great number of discrete planar sides may be used to provide a fixture which appears generally circular or oval shaped.

Figure 6:
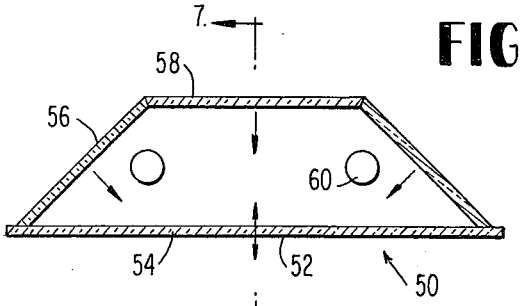
FIG. 6 is a horizontal cross-sectional view of another embodiment of light fixture constructed in accordance with the present invention.
Figure 7:
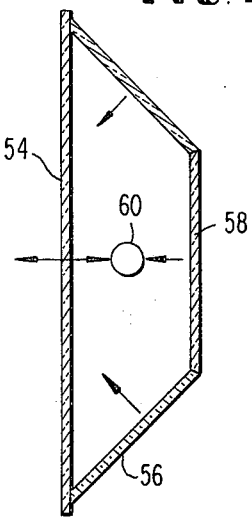
FIG. 7 is a cross-sectional view taken generally about on line 7—7 in FIG. 6.
Figure 8:
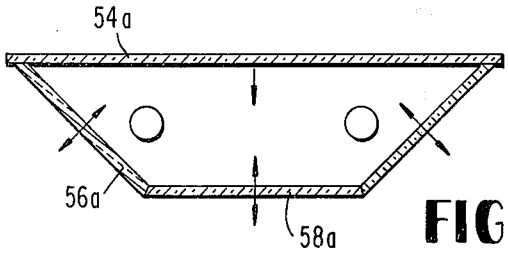
FIG. 8 is a view similar to FIG. 6 showing a further variation of the light fixture of FIG. 6.

Referring now to the embodiments hereof illustrated in FIGS. 6–8, there is illustrated a light fixture generally designated 50 comprised of a housing 52 defined by a rectangular planar wall 54, four side walls 56, each having an edge adjacent an edge of rectangular wall 54 and extending in a plane forming an acute angle with the plane of wall 54, and a wall 58 spaced from and parallel to wall 54 and connected to and along the outer edtes of walls 56. The walls of housing 52 thus define a trapezoid in both horizontal and vertical cross-section. In this form, a pair of light sources, i.e., light bulb 60, are disposed within housing 52 adjacent opposite sides thereof with suitable wires therefor, not shown, for connecting the bulbs with a source of electricity. As illustrated by the arrows in FIGS. 6 and 7, the wall 54 of fixture 50 is comprised of a two-way mirror having the coated surface on the side thereof facing light source 60. Each of the side walls 56 and wall 58 are formed of standard one-way mirrors. Consequently, part of the light rays reflected by the one-way mirrors 56 and 58 are transmitted through wall 54 while parts are reflected back to the one-way mirrors for further reflection and transmission. As in the prior embodiments, a three-dimensional multi light source effect is provided with the apparent multiple light sources diminishing in intensity and size and fading in depth in the fixture. Also produced is a kaleidoscopic light pattern when the fixture is viewed from various angles.

An alternate form of this embodiment is illustrated in FIG. 8 wherein the type of mirrors are reversed from those illustrated in FIGS. 6–7. That is, the large planar mirror 54*a* constitutes a one-way mirror while the four side mirrors 56*a* as well as the mirror 58*a* parallel to mirror 54*a* comprise two-way mirrors. The visual effect produced is similar to the effect described above with respect to the form of light fixture illustrated in FIGS. 6 and 7.

Figure 9:
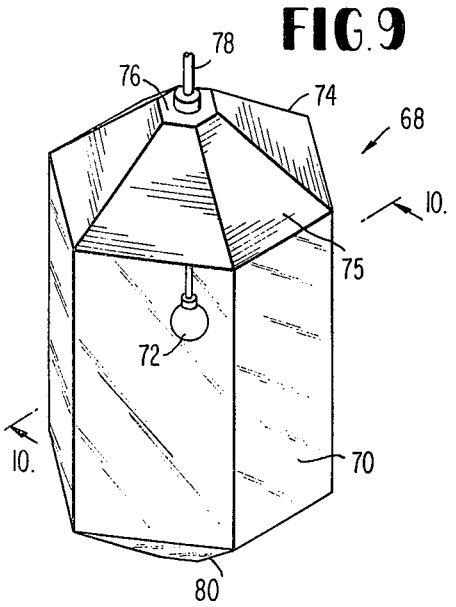
FIG. 9 is a perspective view of another form of light fixture constructed in accordance with the present invention.
Figure 10:
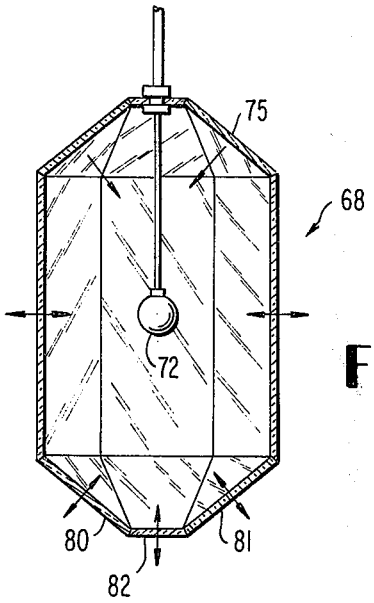
FIG. 10 is a cross-sectional view thereof taken about on line 10—10 in FIG. 9.

Referring now to FIGS. 9–10, there is illustrated a hanging cage-type light fixture generally designated 68. In this form, light fixture 68 comprises a hexagonal cage with angled top and bottom wall surfaces. Particularly, the angularly related side walls 70 are each formed of a two-way mirror with the coated surface thereof lying in opposition to the light source, i.e., bulb, 72. The top surface is formed of truncated triangular panels 75 which incline inwardly toward a central support 76 through which a cord for supporting the fixture and supplying electricity to the light source 72 is provided. The truncated panels 75 are formed of standard one-way mirror material such that the light incident thereon from light bulb 72 is reflected back into the cage. The lower wall surface 80 is similarly formed of truncated triangularly shaped panels 81 which are comprised of two-way mirrors with their coated sides in opposition to the light source 72. The short edge of the lower truncated panels terminate at and are suitably secured to a central two-way mirror 82. Mirror 82 has its coated side in opposition to light source 72. Three-dimensional multiple discrete light sources are visually produced when the fixture is viewed from the side or bottom with the apparent discrete sources diminishing in intensity and size and fading into infinity into the fixture. A kaleidoscopic pattern of light is also visually produced when the fixture is viewed from different angles.

Figure 11:
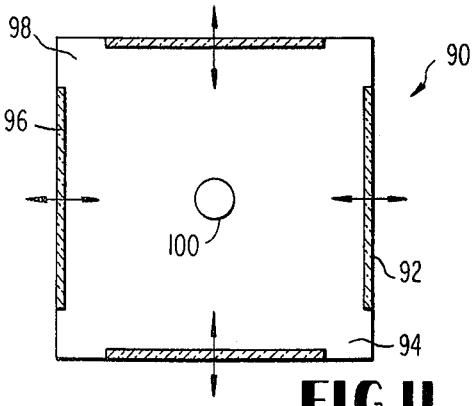
FIG. 11 is a horizontal cross-sectional view of still another form of light fixture constructed in accordance with the present invention.

Referring now to the embodiment hereof illustrated in FIG. 11, there is illustrated in horizontal cross-section a further form of light fixture hereof generally designated 90 and comprised of an enclosure or housing 92 including upper and lower walls, only the lower wall 94 being illustrated, and a plurality of side walls each normally related to the adjacent pair of side walls. The upper and lower walls may comprise standard one-way or two-way mirrors or one may comprise a one-way mirror and the other a two-way mirror. The side walls 96 are suitably secured to the upper and lower walls by means not shown and the adjacent edges thereof are spaced one from the other to define open ends 98 between next adjacent side walls 96. Side walls 96 comprise two-way mirrors with the reflective surface thereof facing and in opposition to a light sourcee, for example a light bulb, 100 disposed in housing 92. The enclosure 92 may be comprised of three or more walls arranged about the light source such that enclosure 92 may be triangular, rectangular, pentagonal etc. Such walls would be spaced one from the other to define openings into the enclosure. The multiple three dimension light effect including the kaleidoscopic effect previously described is also produced by the light fixture illustrated in FIG. 11.

Figure 12:
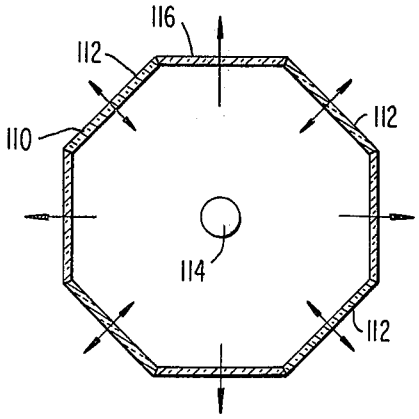
FIG. 12 is a horizontal cross-sectional view illustrating a still further form of light fixture constructed in accordance with the present invention.

Referring now to the embodiment hereof illustrated in FIG. 12, there is illustrated a light fixture cage similar to the cage illustrated in FIGS. 9 and 10. In this form, the cage is octagonal in planform. The side walls 110 are alternately formed of mirrored surfaces and a transparent or translucent material, for example clear or smoked plastic or glass. Side walls or panels 112 preferably constitute two-way mirrors with the reflective surfaces thereof in opposition to the light source 114 within the enclosure. The walls 116 may be formed, for example, of clear or smoked plastic or glass and such walls 112 and 116 are alternately arranged about the fixture. As in the prior embodiment, upper and lower walls may be provided and comprised of either two-way or one-way mirrors or one wall may be a one-way mirror while the other wall may be a two-way mirror. The optical effect provided by the foregoing arrangement is similar to the effect previously described.

From the foregoing, it will be appreciated that the present invention provides a novel light fixture which produces a novel and unusual lighting effect in that, from one or a minimum number of light sources, i.e., bulbs, there is produced a three-dimensional multiple light source effect which diminishes in intensity and size and fades with depth into the fixture and which provides a kaleidoscopic effect when viewed from different angles. This effect is similar to a multiple bulb chandelier but is derived in an inexpensive manner and from preferably only a single light source. It will also be appreciated that the light fixture hereof can be variously mounted. For example, the light fixture can be hung from ceiling or other overhead structure, wall mounted, mounted on a pedestal or a table, etc. and thereby disposed in any convenient position or area of a house, office and the like. Also, while the reflective surface has been described herein as being located on the side of the mirror directly exposed to the light source, the reflective surface may also be mounted on the side remote from the source. Still further, the light fixture hereof can be used in conjunction with fluorescent, flame, intermittent and other types of light sources and is of course not restricted for use with an electric bulb.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be claimed by United States Letters Patent is:

1. A light fixture comprising a housing, a light source carried by and disposed substantially centrally within said housing, said housing including a plurality of reflective surfaces disposed about said light source and comprising a first planar two-way mirror, second and third planar mirrors each including one of said plurality of reflective surfaces, said first two-way mirror being carried by said housing along one side of said light source and said second mirror being carried by said housing along another side of said light source and disposed in a plane at an angle other than 90° with respect to the plane containing said first mirror, said third mirror being carried by said housing along another side of said light source and disposed in a plane at an angle other than 90° with respect to said first planar two-way mirror said mirrors being arranged about said light source such that at least a portion of the light rays generated by said light source are reflected by the reflective surfaces of said second and third mirrors for passage through said first mirror and another portion of the light rays are reflected by the reflective surface of said first mirror interiorly of said housing for further reflection by said reflective surfaces and passage through said first mirror whereby a three-dimensional multiple light source effect comprised of a series of discrete light sources which diminish in intensity and size with depth and repetitiously fade to infinity within said housing is provided when the light source is viewed through said first mirror.

2. A lighting fixture according to claim 1 wherein said third mirror is a two-way mirror having an interiorly directed reflective surface whereby at least a portion of the light rays generated by said light source are reflected by the reflective surfaces of said first and second mirrors for passage through said third mirror and another portion of the light rays are reflected by the reflective surface of said third mirror interiorly of said housing for further reflection by said reflective surfaces and passage through said third mirror whereby a three-dimensional multiple light source effect comprised of a series of discrete light sources which diminish in intensity and size with depth and repetitiously fade to infinity within said housing is provided when the light source is viewed through said third mirror.

3. A light fixture according to claim 2 wherein said second mirror is a two-way mirror having an interiorly directed reflective surface whereby at least a portion of the light rays generated by said light source are reflected by the reflective surfaces of said first and third mirrors for passage through said second mirror and another portion of the light rays are reflected by the reflective surface of said second mirror interiorly of said housing for further reflection by said reflective surfaces and passage through said second mirror whereby a three-dimensional multiple light source effect comprised of a series of discrete light sources which diminish in intensity and size with depth and repetitiously fade to infinity within said housing is provided when the light source is viewed through said second mirror.

4. A light fixture according to claim 1 wherein said third mirror is a one-way mirror.

5. A light source according to claim 4 wherein said second mirror is a one-way mirror.

6. A light fixture according to claim 1 wherein said housing has walls constituting an enclosure about said light source, said first, second and third mirrors comprising at least a portion of said walls about said light source.

7. A light fixture according to claim 6 wherein said third mirror constitutes a one-way mirror, each of said second and third mirrors forming acute angles with said first mirror along opposite edges of said first mirror.

8. A light fixture according to claim 6 wherein said second mirror is a two-way mirror having an interiorly directed reflective surface whereby at least a portion of the light rays generated by said light source are reflected by the reflective surfaces of said first and third mirrors for passage through said second mirror and another portion of the light rays are reflected by the reflective surface of said second mirror interiorly of said housing for further reflection by said reflective surfaces and passage through said second mirror whereby a three-dimensional multiple light source effect comprised of a series of discrete light sources which diminish in intensity and size with depth and repetitiously fade to infinity within said housing is provided when the light source is viewed through said second mirror, said third mirror being a two-way mirror having an interiorly directed reflective surface whereby at least a portion of the light rays generated by said light source are reflected by the reflective surfaces of said first and second mirrors for passage through said third mirror and another portion of the light rays are reflected by the reflective surface of said third mirror interiorly of said housing for further reflection by said reflective surfaces and passage through said third mirror whereby a three-dimensional multiple light source effect comprised of a series of discrete light sources which diminish in intensity and size with depth and repetitiously fade to infinity within said housing is provided when the light source is viewed through said third mirror, said second and third mirrors each forming an obtuse angle with said first mirror along the respective opposite sides of said first mirror.

9. A light fixture according to claim 1 wherein said third mirror is a two-way mirror having an interiorly directed reflective surface whereby at least a portion of the light rays generated by said light source are reflected by the reflective surfaces of said first and second mirrors for passage through said third mirror and another portion of the light rays are reflected by the reflective surface of said third mirror interiorly of said housing for further reflection by said reflective surfaces and passage through said third mirror whereby a three-dimensional multiple light source effect comprised of a series of discrete light sources which diminish in intensity and size with depth an repetitiously fade to infinity within said housing is provided when the light source is viewed through said third mirror, said mirrors forming an enclosure for said fixture having top, bottom and side walls, said first mirror forming a part of the side wall of said fixture, said second mirror forming a part of one of said top and bottoom walls of said fixture, said third mirror forming a part of the other of the other of said top and bottom walls of said fixture.

10. A light fixture according to claim 1 wherein said light source consists of a single electric light bulb.

11. A light fixture according to claim 9 wherein said second mirror constitutes a one-way mirror, said second and third mirrors forming obtuse angles with said first mirror along opposite side edges thereof.

* * * * *